US006505405B2

(12) United States Patent
Hui

(10) Patent No.: US 6,505,405 B2
(45) Date of Patent: Jan. 14, 2003

(54) ELECTRIC CAN OPENER

(75) Inventor: Alex Ka Po Hui, Hong Kong (HK)

(73) Assignee: Main Power Electrical Factory Limited (HK)

( * ) Notice: Subject to any disclaimer, the term of this patent is extended or adjusted under 35 U.S.C. 154(b) by 0 days.

(21) Appl. No.: 09/827,016

(22) Filed: Apr. 5, 2001

(65) Prior Publication Data

US 2002/0144412 A1 Oct. 10, 2002

(51) Int. Cl.[7] ..... B67B 7/70

(52) U.S. Cl. ..... 30/421; 30/419; 30/423; 30/410

(58) Field of Search ..... 30/410, 416, 419, 30/421, 423, 433, 434, 417

(56) References Cited

U.S. PATENT DOCUMENTS

| | | | | |
|---|---|---|---|---|
| 3,254,406 A | * | 6/1966 | Hubrich | 30/410 |
| 3,675,321 A | * | 7/1972 | Arel et al. | 30/421 |
| 4,922,617 A | * | 5/1990 | Kurz | 30/419 |
| 6,189,221 B1 | * | 2/2001 | Barrow et al. | 30/421 |

* cited by examiner

*Primary Examiner*—Hwei-Siu Payer
(74) *Attorney, Agent, or Firm*—Jackson Walker L.L.P.

(57) ABSTRACT

An electric can opener has a handle that is used to 'close' a blade towards a traction wheel so as to pinch a top rim of a can while the lid is removed, in a known manner. When the handle is moved downwards, the blade is carefully controlled in its movement as the result of the cooperation of three cams mounted on a pivot shaft of the handle. The blade is moved sideways and downwards so as to arrive at the pinching position in a manner that ensures that the rim is not jammed from above and that vertical thrust is applied during the can opening operation.

5 Claims, 5 Drawing Sheets

ELECTRIC CAN OPENER

BACKGROUND OF THE INVENTION

1. Field of the Invention

The invention relates to electric can openers.

2. Description of Prior Art

The invention relates to generally portable openers that have a tower that can rest on a horizontal work-surface to support a can at one side of the tower while removing its top lid. The can is supported by pinching a top rim of the can between a cutting blade and a traction wheel (driven by an electric motor inside the tower). The traction wheel rotates about a horizontal axis and rotates the can about a vertical axis to enable the blade to severe into a top peripheral surface of the lid. A hinged magnetic lifter is provided to hold the lid up above the can when the lid has been completely severed and the can is released and lowered away from the side of the tower. Such can openers are already well-known.

The pinching is achieved by manually rotating a blade mounting assembly about an axis above the axis of rotation of the traction wheel to bring the blade downwards so that a top rim of the can is trapped between and pressed by the blade against the traction wheel. The blade must press downwards and sideways, toward the tower, and the traction wheel must exert relative forces away from the tower and upwards against a lower outside surface of the rim. At the same time the blade must be moveable well-away from the friction wheel to allow the rim of the can to be entered between the blade and the traction wheel and removed, after the lid has been severed, with relative easy and convenience. This is achieved in present day arrangements by lowering a cutting blade 'diagonally' towards the top surface of the can. This means that the cutting blade thrust is not vertically downwards in use. Also, it is inherently possible to cut only a top part of a can rim off so as to leave the can sealed or partially sealed.

SUMMARY OF THE INVENTION

It is an object of the invention to overcome or at least reduce these problems.

According to the invention there is provided an electric can opener having an upright tower, a traction wheel mounted on a side of the tower adjacent a top thereof and arranged to be driven by an electric motor about a first horizontal axis, a cutting blade for opening the cam that is supported by a blade mounting assembly that is rotatable about a second horizontal axis above the first horizontal axis and supported by the tower, a handle coupled the blade mounting assembly and vertically pivotable about the second horizontal axis to move the blade between a first position where the blade urges downwards against a top of a can lid to pinch a rim of the lid against the traction wheel and a second position where the blade is sufficiently separated from the traction wheel to allow an outer peripheral top rim of the can to be presented to or removed from against a side of the tower, in which the blade mounting assembly includes cam means rotatable about the second horizontal axis that is configured to cause the blade to move horizontally during movement between the first position and second position.

The cam means is preferably configured such that the blade is caused to move only vertically downwards during its final travel towards the pinched position.

The electric can opener preferably includes two like opposing cams configured to cause the blade to move horizontally towards and away for the tower respectively, during movement between the first and second positions.

The blade mounting assembly may include an axle mounted to rotate about the second horizontal axis, a slidable axle sleeve that is formed with the cam means, and a manually operable releasable lock mounted in the tower to releasably lock the sleeve to the tower while allowing the axle to rotate and to move horizontally.

The blade is preferably rotatably supported on the axle and constrained to rotate relative to the blade mounting assembly through an arc of approximately 20° C. about the vertical axis.

BRIEF DESCRIPTION OF THE DRAWINGS

An electric can opener according to the invention will now be described by way of example with reference to the accompanying drawings in which.

DESCRIPTION OF THE PREFERRED EMBODIMENTS

Figure 1:
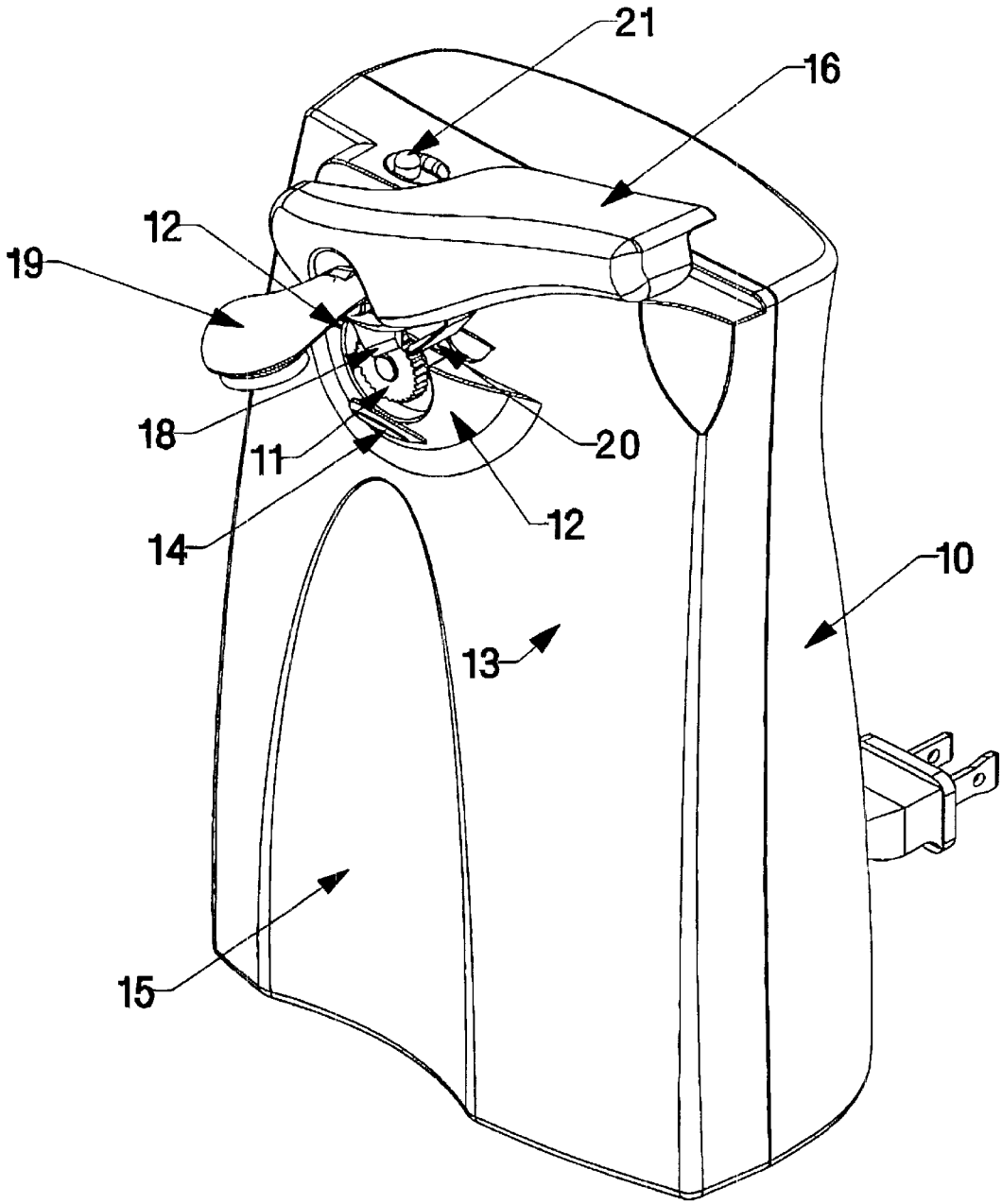
FIG. 1. is an isometric view of one side of the can opener.

Referring to the drawings, in FIG. 1 the can opener has tower 10 that has traction wheel 11 rotatably supported about a first horizontal axis and exposed between an integrally formed guard 12 in a front face 13 of the tower. The front face 13 has ledge 14 within the guard 12 against which a side of a can is urged in use when "opening the can". An indentation 15 is provided to allow the can at lie at least substantially vertically adjacent the side of the tower 10.

A manually operable handle 16 is mounted to an axle 17 (see FIG. 2) of a cutting blade mounting assembly. The axle 17 is supported by the tower to rotate about a second horizontal axis above the first horizontal axis, as explained below. A cutting blade 18 is provided for shearing a top surface of the can to 'open the can'. A pivotably mounted magnetic lifter 19 is provided for holding the lid when it has been sheared from the top surface, in a manner already well-known. A resilient metal finger guard 20 is mounted on an underside of the handle 16. A manual lock 21 is for locking the handle 16, together with the mounting blade assembly, to the tower 10.

Figure 2:
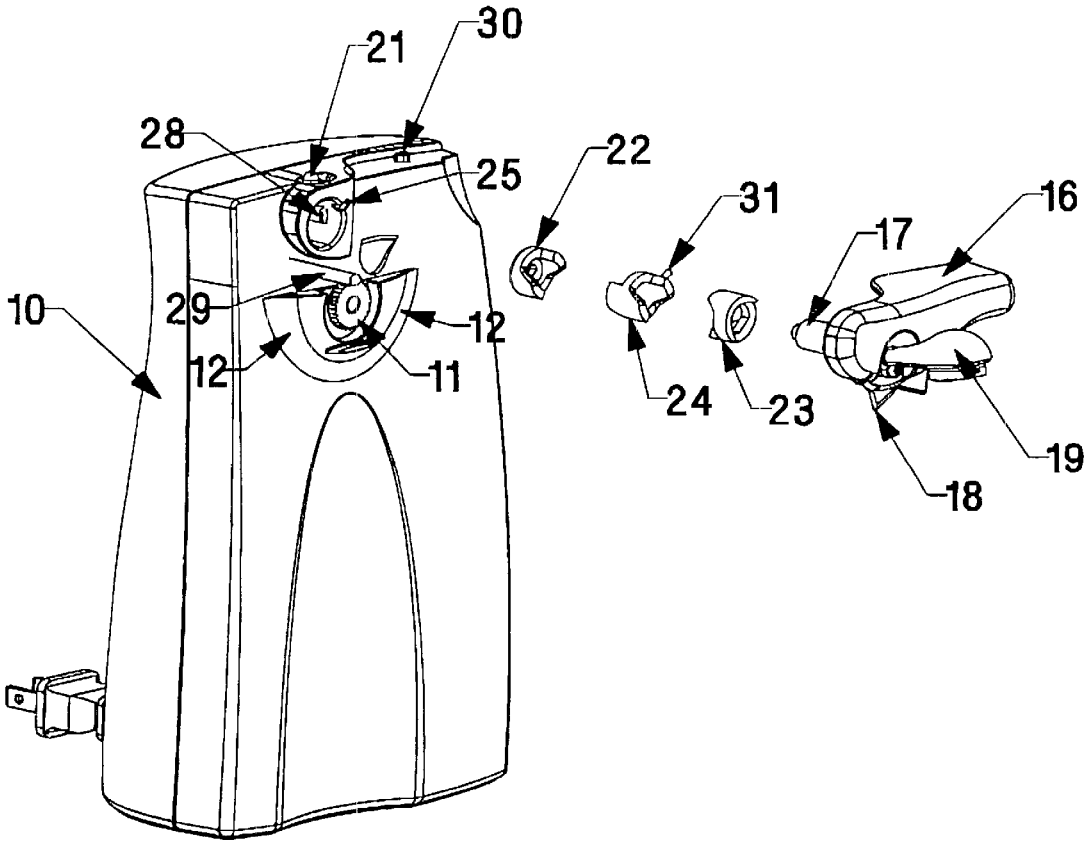
FIG. 2 is an isometric exploded view of the one side of the can opener from a different direction.

In FIG. 2, the handle 16 and, the especially blade mounting assembly, are more clearly seen, The blade 18 is supported by and at one end the axle 17. Three cams (or cammed sleeves) 22, 23 and 24 mount to the shaft 17. The cams 22 and 23 are fixed on the shaft in use and the cam 24 is free to rotate relative to the shaft. The cam 24 has a locating pin 31 that fits to a slot 25 in the tower 10. Next to the pin 31, the cam 24 has a slot 27 (see FIG. 3) in its outer surface that can be engaged by a locking bar 28 which effectively holds the cam 24 to the tower 10 during normal use. The lock 21 can be used to release the cam 24, and hence the shaft 17, from the tower 10 to allow the handle and blade mounting assembly to be removed for cleaning or storage. This also exposes the traction wheel 11 for easier cleaning.

The shaft 17 can move horizontally with respect to the tower 10 and, importantly, is urged by the cams 22, 23 and 24 to move horizontally when the shaft is rotated by the handle 16, as explained below. The. blade 18 is thereby moved between a position when a rim of a can is pinched between the blade 18 and the friction wheel 11 and a position where the blade 18 and friction wheel 11 are sufficiently separated (or "open") to allow the rim of the can to be easily entered into and removed from a can opening position, where the body of the can lies against a side of the tower 10. A stop pin 29 mounted to the tower 10 bears against the top surface of the can to help hold the can vertical while the can is being opened.

Figure 3:
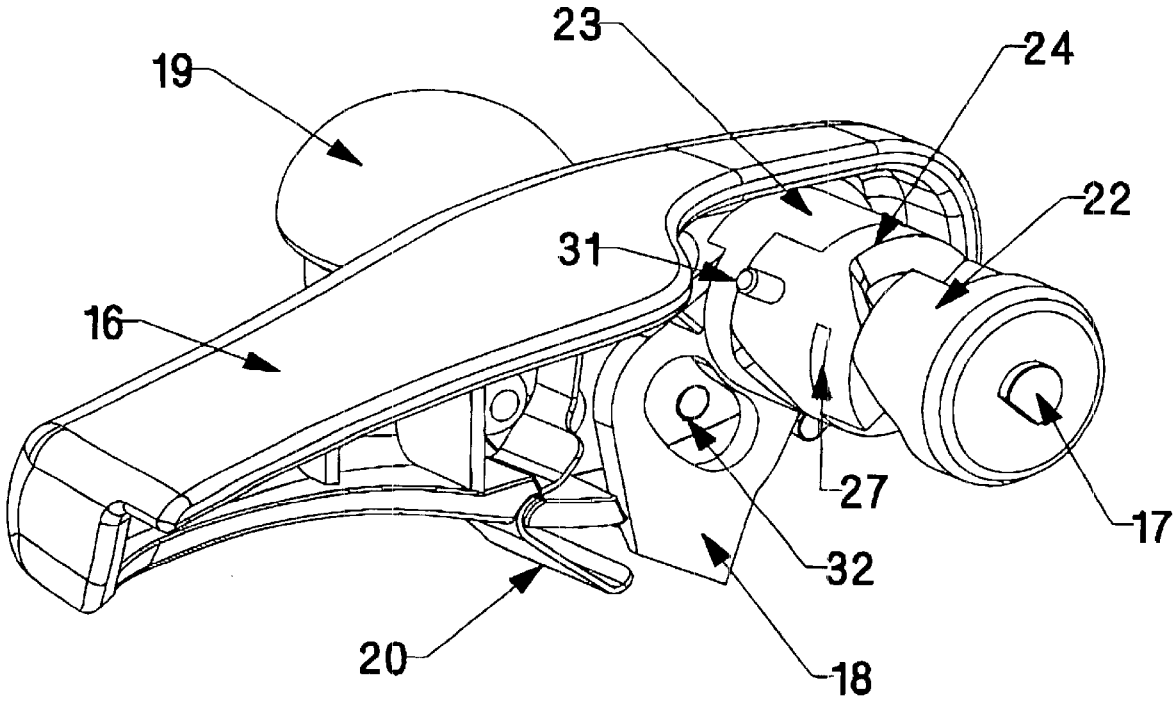
FIG. 3 is an isometric view a manual operatable handle of the can openers.

The blade 18 is rotatably supported by the axle 17 (as best seen in FIG. 3) and is constrained to move through a vertical arc of approximately 20° C., determined by a central stop 32. This enables the blade to provide a 'soft cut' feature using the operation of the motor and traction wheel to pierce the can. In use, the blade 18 is pressed against the top surface of the can, without piercing the can, by moving down the handle 16. When the traction wheel starts, the can rotates and the blade swings against the stop 32 and pierces the top of the can. Thus, less initial downward force is required to be applied by a user when preparing to open the can.

It will be recalled as explained above that the cam 24 is rotationally and horizontally locked to the tower 10 in normal use. This ensures that the actual relative movement of the blade 18 is very carefully controlled by the mechanical configurations provided by the cams, as best illustrated by reference to FIGS. 4 and 5.

Figure 4:
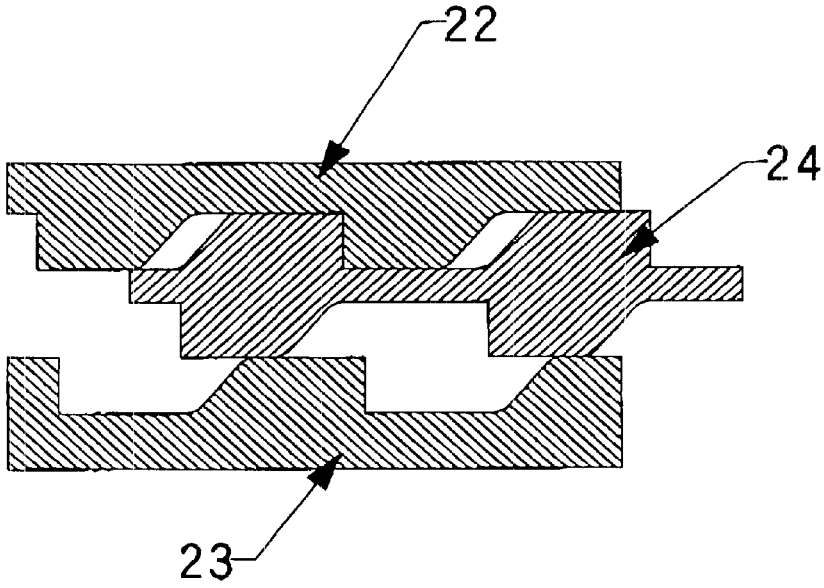
FIG. 4 is a first configuration of cam developments of cams used in the can opener.
Figure 5:
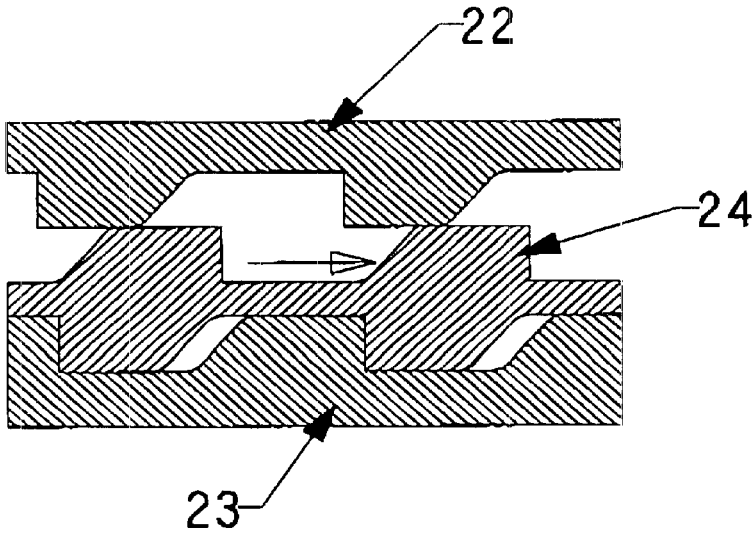
FIG. 5 is a second configuration of cam developments of the cams.
Figure 6:
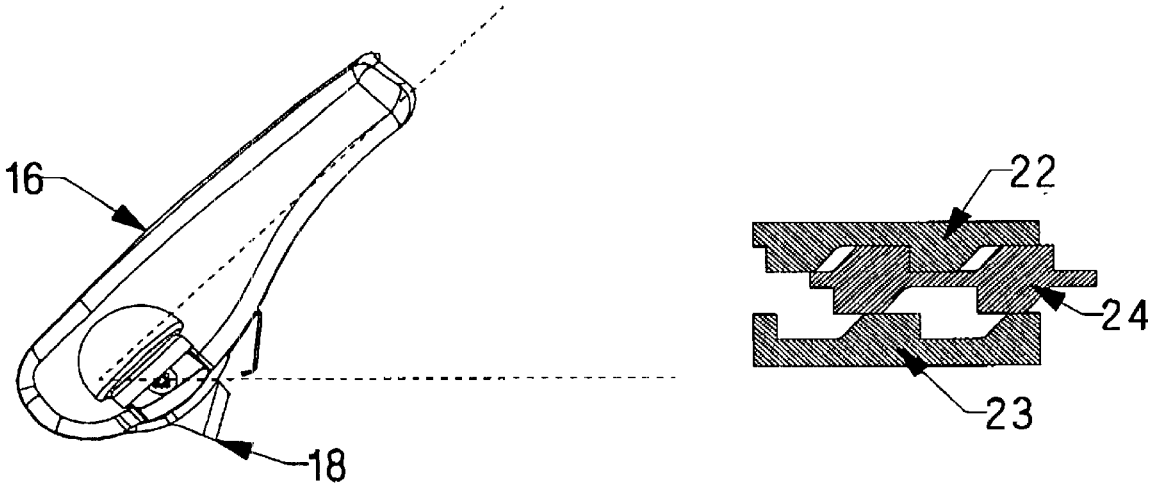
FIG. 6 shows the cam developments and a corresponding first handle position.
Figure 7:
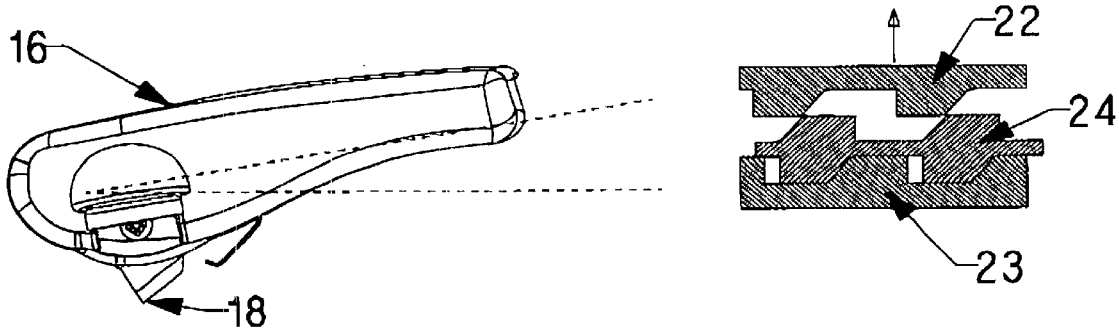
FIG. 7 shows the cam developments and a corresponding second handle position.
Figure 8:
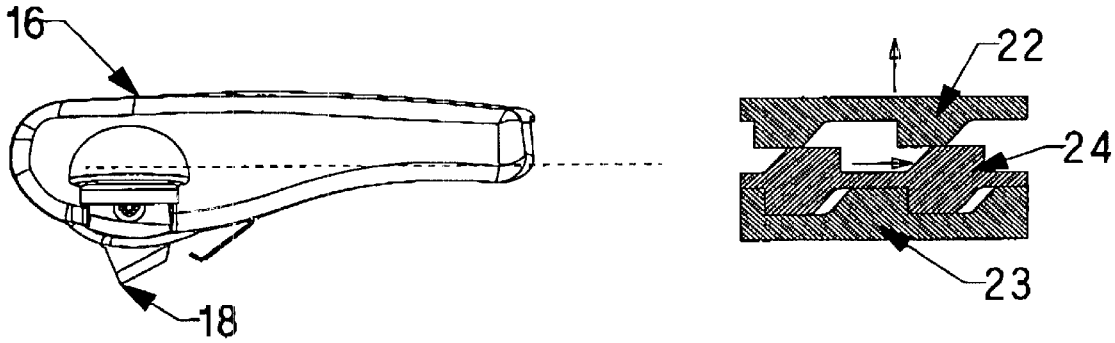
FIG. 8 shows the cam developments and a corresponding third handle position.

FIG. 4 represents the 'open' condition and FIG. 5 represents the 'pinched' condition. It can be appreciated, starting with FIG. 4, that when relative motion takes place between the cams initially, to 'close' the blade, the cam 22 in FIG. 4 will move relatively sideways to the right. As a result, the blade 18 is moved vertically downwards. During the next or further movement of the handle, the cam 22 is pushed upwards and sideways, in FIG. 4, so that the blade is moved vertically downwards and also horizontally towards the tower 10, while sloping sides of the cams slide against and along one another. During a final stage of the relative movement to the position FIG. 5, the cams move only relatively sideways. Thus, the blade moves only vertically downwards (and not horizontally) during this final stage of the movement. By reference to FIG. 6, it can therefore be appreciated what happens when the operating handle is pressed down to pinch the rim of a can against the friction wheel 11 for opening the cam.

Thus, during 'closing', the blade, to the fully pinched condition of the cams (shown in FIG. 5 ), the blade 18 is brought first vertically downwards, then sideways and downwards (i.e. diagonally towards the rim), and finally downwards. This means it is impossible or very much less likely that the blade will ever be brought down against a top surface of the rim. This is ensured while at the same time as presenting the cutting blade with a vertical downwards thrust during piercing (i.e. during the final downwards movement of the blade) and during cutting into the top of the surface can during use. This described action also makes the handle 16 easier to move between its extreme operative positions.

It will be appreciated that whereas three cams are described, the required relative movement of the cutting blade 18 could be achieved using only two cams, cams 23 and 24, say. In that case, the cams 23 and 24 are biased against one another, by a spring say, to ensure that the cooperating camming surfaces remain and are urged into intimate contact and remain in intimate contact throughout operative movements of the handle 16. It in also possible to configure the cams to eliminate the vertical movement of the blade during the initial movement of the handle from the fully open position, where preferred.

At completion of the final downward vertical movement of the cutting blade 18, the handle presses against a spring biased electrical switch button 30 to turn ON an electrical motor to rotate the friction wheel 11, as required, for opening the can. During the opening, the guard 20 is pressed against the top of the rim of the can to resist torque produced by the blade, and when the handle is released, the guard raises the handle up to ensure the button 30 is released and the motor is turned OFF.

I claim:

1. An electric can opener having an upright tower, a traction wheel mounted on a side of the tower adjacent a top thereof and arranged to be driven by an electric motor and about a first horizontal axis, a cutting blade for opening a can that is supported by a blade mounting assembly that is rotatable about a second horizontal axis above the first horizontal axis and supported by the tower, a handle coupled to the blade mounting assembly and vertically pivotable about the second horizontal axis to move the blade between a first position where the blade urges downwards against a top of a can lid to pinch a rim of the lid against the traction wheel and a second position where the blade is separated from the traction wheel to allow an outer peripheral top rim of the can to be presented to or removed from against a side of the tower, in which the blade mounting assembly includes cam means rotatable about the second horizontal axis that is configured to cause the blade to move horizontally during movement between the first position and the second position.

2. An electric can opener according to claim 1, in which the cam means is configured such that the blade is caused to move only vertically downwards during its final travel towards the first position.

3. An electric can opener according to claim 1, including two opposing cams configured to cause the blade to move horizontally towards and away from the tower respectively, during movement between the first and second positions.

4. An electric can opener according to claim 1, in which the blade mounting assembly includes an axle mounted to rotate about the second horizontal axis, a slidable axle sleeve that is formed with the cam means, and a manually operable releasable lock mounted in the tower to releasably lock the sleeve to the tower.

5. An electric can opener according to claim 4, in which the blade is rotatably supported on the axle and constrained to rotate relative to the blade mounting assembly through an arc of approximately 20° about the vertical axis.

* * * * *